United States Patent [19]

Aubert

[11] Patent Number: 4,823,101

[45] Date of Patent: Apr. 18, 1989

[54] METHOD OF MANUFACTURING A BITTER TYPE COIL AND A SOLENOID MAGNET OBTAINED THEREBY

[75] Inventor: Guy Aubert, Grenoble, France

[73] Assignee: Centre National De La Recherche Scientifique, Paris, France

[21] Appl. No.: 926,416

[22] PCT Filed: Feb. 21, 1986

[86] PCT No.: PCT/FR86/00056

§ 371 Date: Oct. 16, 1986

§ 102(e) Date: Oct. 16, 1986

[87] PCT Pub. No.: WO86/05312

PCT Pub. Date: Sep. 12, 1986

[30] Foreign Application Priority Data

Feb. 28, 1985 [FR] France ..... 85 02971

[51] Int. Cl.[4] ..... H01F 5/00

[52] U.S. Cl. ..... 335/299; 79/DIG. 22; 403/272

[58] Field of Search ..... 335/209, 296, 299; 29/873, DIG. 22; 174/94 R; 403/271, 272, 339; 439/824

[56] References Cited

U.S. PATENT DOCUMENTS

| | | | |
|---|---|---|---|
| 2,438,967 | 4/1948 | Ellsworth | 29/DIG. 22 |
| 3,497,951 | 3/1970 | Reighter | 174/94 R |
| 3,864,507 | 2/1975 | Fox et al. | 174/14 R |
| 4,165,148 | 8/1979 | Campbell et al. | 174/94 R |

FOREIGN PATENT DOCUMENTS

| | | | |
|---|---|---|---|
| 1209196 | 2/1960 | France | 335/299 |
| 1494887 | 8/1967 | France | 335/299 |
| 2175530 | 10/1973 | France | 335/299 |

*Primary Examiner*—George Harris

*Attorney, Agent, or Firm*—Oblon, Fisher, Spivak, McClelland & Maier

[57] ABSTRACT

A method is provided for manufacturing a Bitter coil by indium welding and a solenoid magnet obtained by using this method. The Bitter disks or parts of such disks are welded with an indium filler, deposited preferably electrolytically on the portions to be assembled together.

7 Claims, 2 Drawing Sheets

METHOD OF MANUFACTURING A BITTER TYPE COIL AND A SOLENOID MAGNET OBTAINED THEREBY

BACKGROUND OF THE INVENTION

1. Field of the Invention

The invention relates to a method of manufacturing a Bitter type coil, entering more particularly into the construction of a large sized magnet able to be used in a nuclear magnetic resonance (NMR) image forming installation. The invention also relates to a solenoid magnet having at least one Bitter type coil constructed by using this method.

2. Description of the Prior Art

It is known that NMR image forming installations require a large sized magnet capable of generating a uniform magnetic field in a given region of space. Typically, it is necessary to generate a magnetic field of 0.15 to 0.5 teslas with a homogeneity of 1 to 10 parts per million (ppm) in a sphere having a diameter of 40 cm at least.

Furthermore, Bitter coils are well known for producing intense magnetic fields. The structure proposed by Bitter is a winding formed of metal annular disks (generally made from copper or aluminium) split so as to form as many turns and connected so as to define a substantially helical winding with flat turns. The stack of disks is held in position by a plurality of tie rods. This structure is advantageous for it allows efficient cooling of the magnet, by forming holes in the disks (and in the insulators separating these disks). These holes are disposed in the same configuration from one disk to another so as to form a set of channels parallel to the axis of the coil. A cooling fluid, for example deionized water, kerosene or oil, flows in the channels.

It is possible to calculate a magnet delivering a magnetic field of required homogeneity in a certain volume in the vicinity of its center of symmetry and formed of a number of such Bitter coils arranged along a common longitudinal axis. Methods of calculating such magnets are for example explained in other patent applications of the applicant.

SUMMARY OF THE INVENTION

The invention relates mainly to a method of constructing such a Bitter type coil, consisting in forming a winding of turns in the form of flat annular metal disks and jointingly stacking such disks, wherein such disks or parts of such disks are connected end to end by welding with indium as filler.

Indium welding may be carried out at a relatively low temperature (of the order of 200° C.) so as to avoid deformation of the disks or disk portions, which allows a particularly regular winding to be obtained with jointing turns. In addition, indium has the additional advantage of an excellent electric conductivity.

Furthermore, the indium is preferably deposited before welding by electrolytic deposition on portions to be assembled together. Welding is then carried out by heating the portions in the assembled position, for example by means of a "HF turn". In one possible embodiment, the portions to be assembled together are provided with tongues and grooves of complementary shapes and dimensions, and the indium is deposited on these tongues and grooves.

BRIEF DESCRIPTION OF THE DRAWINGS

The invention will be better understood and other advantages thereof will better appear from the following description, given solely by way of example with reference to the accompanying drawings in which.

DESCRIPTION OF THE PREFERRED EMBODIMENT OF THE INVENTION

Figure 1:
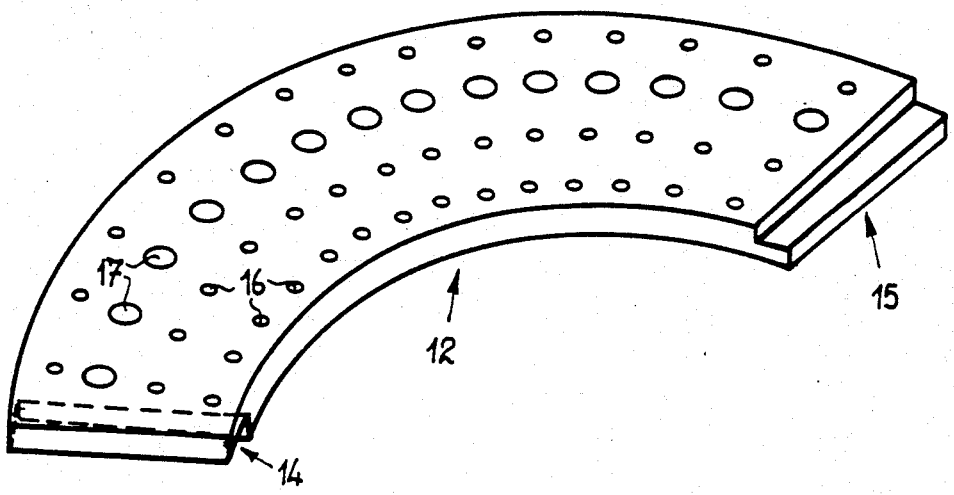
FIG. 1 shows a disk part used for forming a Bitter type coil.
Figure 2:
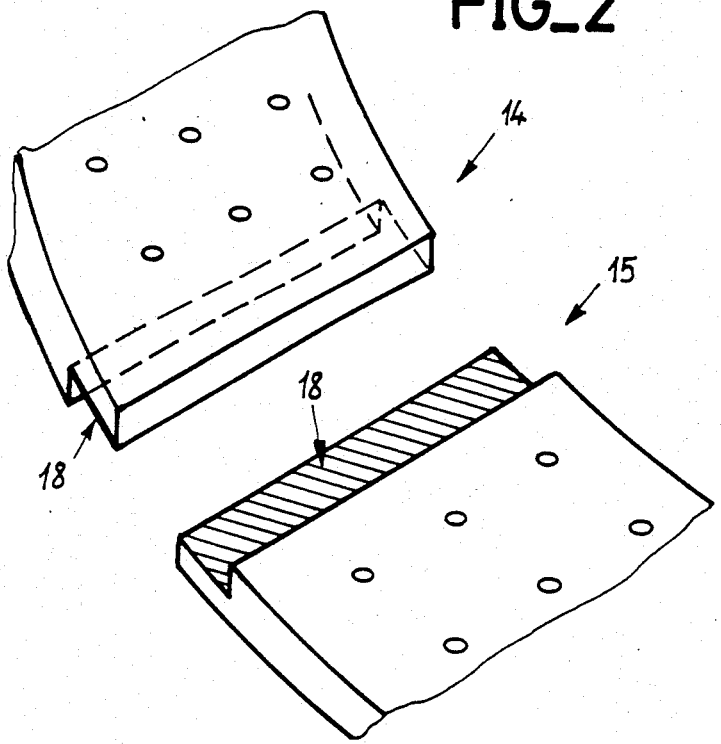
FIG. 2 is a detailed view illustrating the assembly of two similar disk parts, after the indium has been deposited and before welding the parts.
Figure 3:
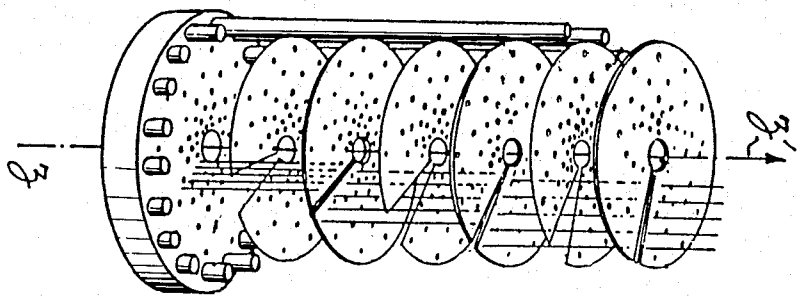
FIG. 3 shows the winding of turns in the form of flat metal annular disks by jointingly stacking such disks.

Referring to the drawings, the basic structure used in the invention has been shown for forming a large size Bitter coil usable more particularly in an NMR image forming installation for generating a uniform magnetic field of high homogeneity. Each coil is formed of the end to end assembly of flat annular disk parts 12. Each disk part 12 comprises, in the example shown, opposite tongues and grooves 14, 15, of complementary shapes and dimensions, at each of its ends respectively. Thus, the tongue 14 of one disk part 12 may be assembled by welding to the groove 15 of another adjacent disk part 12 and so on with interpositioning of an insulator between the turns, until the complete Bitter coil is formed. As shown, each disk part 12 has holes 16 in a predetermined configuration which, with the corresponding holes 16 in the disk parts 12 of the other turns, form cooling fluid flow channels parallel to the axis of the coil.

Other holes 17 of a larger diameter are also provided in each disk part for passing therethrough tie rods securing the jointing turn coil, in accordance with the conventional technique defined by Bitter.

According to the invention, the disk parts 12 are welded together using an indium filler by heating at a relatively low temperature, which avoids the deformation of the Bitter disks whose thickness is of the order of 2 mm only for an external diameter of the order of a meter. A fine indium wafer may for example be interpositioned between the tongues 14 and grooves 15 in the assembled position and may be heated for melting the indium. It has been discovered, however, that the accuracy of positioning the parts to be assembled together and the quality of the weld were appreciably improved if the indium 18 is previously deposited electrolytically on the surfaces to be assembled together—that is to say, here on the surfaces of the tongues and grooves 14 and 15. The electrolytic deposition of indium on a copper piece is within the scope of those skilled in the art. It will be carried out preferably after electrolytic polishing of the portions comprising tongues 14 and the grooves 15. The disk parts 12 are precut so that, as shown, each of them represents a fraction of a turn of the coil, here close to a third of a turn. More precisely, the disk parts 12 are all identical and each represents a non whole fraction of a complete turn, (i.e. different from a half, a third, a quarter, . . . ) so that the welded zones of the stack are distributed in the form of a helix and not grouped together along one or more generatrices of the coil.

What is claimed is:

1. A method of manufacturing a Bitter type coil comprising the steps of:

(a) forming a winding of turns in the form of flat metal annular disks by jointingly stacking such disks and (b) joining such disks together end to end by welding with an indium filler, wherein:

(c) the portions to be assembled together each comprises tongues and grooves of complementary shapes and dimensions and (d) the indium is placed on at least one of said tongues and grooves so as to be welded by heating said portions in the assembled position.

2. The method as claimed in claim 1, wherein the indium is deposited before welding by electrolytic deposition on portions to be assembled together.

3. The method as claimed in claim 1 wherein said annular disks represent a fraction of a turn.

4. The method as claimed in claim 3, wherein identical annular disks are successively assembled together, each being different from a whole fraction of a complete turn, so that the welded zones of said stack are distributed in the form of a helix.

5. A solenoid magnet with flat Bitter type annular disks, comprising such disks assembled end to end by indium welding, wherein:

(a) at each welded junction, the indium is in the form of a uniform layer resulting from the melting of two electrolytic deposits of indium on the assembled portions;

(b) the portions to be assembled together each comprises tongues and grooves of complementary shapes and dimensions; and (c) the indium covers at least one of said tongues and grooves.

6. The solenoid magnet as claimed in claim 5 formed by end to end assembly of equal flat annular disks, each representing a fraction of a turn.

7. The solenoid magnet as claimed in claim 6, wherein each annular disk represents a non whole fraction of a complete turn.

* * * * *